US009174259B2

(12) United States Patent
Golovashchenko

(10) Patent No.: US 9,174,259 B2
(45) Date of Patent: Nov. 3, 2015

(54) METHOD AND APPARATUS FOR SHARP FLANGING AND TRIMMING SHEET METAL PANELS

(75) Inventor: Sergey Fedorovich Golovashchenko, Beverly Hills, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 1147 days.

(21) Appl. No.: 13/009,296

(22) Filed: Jan. 19, 2011

(65) Prior Publication Data

US 2012/0180542 A1 Jul. 19, 2012

(51) Int. Cl.

| | |
|---|---|
| ***B21D 19/08*** | (2006.01) |
| ***B21D 22/22*** | (2006.01) |
| ***B21D 22/10*** | (2006.01) |
| ***B21D 24/16*** | (2006.01) |
| ***B21D 26/021*** | (2011.01) |

(52) U.S. Cl.

CPC ..... *B21D 19/08* (2013.01); *B21D 22/10* (2013.01); *B21D 22/22* (2013.01); *B21D 24/16* (2013.01); *B21D 26/021* (2013.01)

(58) Field of Classification Search

CPC ..... B21D 11/02; B21D 19/08; B21D 22/22; B21D 24/10; B21D 22/30; B21D 24/12; B21D 24/14

USPC ..... 72/332, 333, 334, 338, 347, 348, 350, 72/351

See application file for complete search history.

(56) References Cited

U.S. PATENT DOCUMENTS

| | | | | |
|---|---|---|---|---|
| 3,844,154 | A * | 10/1974 | Bozek | 72/336 |
| 4,309,888 | A * | 1/1982 | Miller et al. | 72/334 |
| 4,485,661 | A * | 12/1984 | Hehl | 72/332 |
| 4,587,825 | A * | 5/1986 | Bulso et al. | 72/329 |
| 4,599,885 | A * | 7/1986 | Stone | 72/347 |
| 5,410,927 | A | 5/1995 | Omata et al. | |
| 5,966,976 | A | 10/1999 | Haraga | |
| 6,276,185 | B1 * | 8/2001 | Owens | 72/350 |
| 6,631,630 | B1 | 10/2003 | Pourboghrat et al. | |
| 6,928,848 | B2 | 8/2005 | Golovashchenko et al. | |
| 7,086,265 | B2 * | 8/2006 | Losch | 72/297 |
| 7,237,423 | B1 * | 7/2007 | Nagel et al. | 72/350 |
| 7,861,568 | B2 * | 1/2011 | Nakamura et al. | 72/350 |
| 8,051,696 | B2 * | 11/2011 | Yoshida et al. | 72/347 |
| 8,250,896 | B2 * | 8/2012 | Hirotani | 72/350 |
| 8,341,996 | B2 * | 1/2013 | Hallfeldt et al. | 72/350 |
| 2008/0184764 | A1 * | 8/2008 | Nakamura et al. | 72/350 |
| 2009/0272171 | A1 | 11/2009 | Golovashchenko | |
| 2009/0305075 | A1 * | 12/2009 | Flehmig et al. | 428/603 |

FOREIGN PATENT DOCUMENTS

| | | | |
|---|---|---|---|
| EP | 0266625 | A2 | 5/1988 |
| GB | 1205289 | | 9/1970 |
| WO | 2005077560 | A1 | 8/2005 |

* cited by examiner

*Primary Examiner* — Edward Tolan

(74) *Attorney, Agent, or Firm* — Damian Porcari; Brooks Kushman P.C.

(57) ABSTRACT

A method and apparatus for forming flanges on a panel. The flanges may be weld flanges or hem flanges. The flanges stretch to reduce spring back and may be trimmed. The trimming operation is performed after the flange area is formed on the panel.

4 Claims, 7 Drawing Sheets

METHOD AND APPARATUS FOR SHARP FLANGING AND TRIMMING SHEET METAL PANELS

BACKGROUND

1. Technical Field

This disclosure relates to sheet metal forming tools and processes that are used to form and trim a hem flange or weld flange.

2. Background Art

Vehicle body panels such as deck lids, hoods, doors and the like frequently include a flange that extends about their periphery. Such body panels have traditionally been manufactured from mild steel sheet metal. Mild steel is very ductile and is easily formed in a hem forming operation. Increasingly, automotive manufacturers are turning to aluminum or advanced high strength steel (AHSS) alloys to obtain weight savings for vehicle body panels. Aluminum alloys and AHSS alloys offer high strength/low weight alternatives to mild steel.

Aluminum and AHSS alloys do not, however, have the same degree of ductility and resistance to work hardening offered by mild steel. Forming a flange on a sheet metal body panel made of aluminum or AHSS alloys is more difficult than forming the same flange on a mild steel panel due to the reduced ductility of aluminum or AHSS alloys. One proposed solution to this problem is to form a larger radius hem when making body panels of aluminum sheet metal. Larger radius hems result in lower fit and finish ratings because larger radius hems may cause gaps to appear larger between door closure panels and their openings.

The low ductility of aluminum may cause tears or splits starting from the outer surface of a hem. Tears and splits result in high part rejection rates and unacceptable scrap rates.

Substantial work hardening may occur during the hem flange formation process. The hem flange formation process is the initial step in forming a hem wherein a peripheral portion of a blank or drawn part is bent to about 90 degrees. Forming a 90 degree bend in an aluminum sheet around a relatively tight radius causes substantial amounts of deformation. Stretching the trimmed surface may lead to edge cracking. This amount of strain may result in splits and even tears as the hem flange is further formed in pre-hem and final hem forming steps.

Flanging and hemming of aluminum panels often requires larger radii due to insufficient formability of aluminum alloys (6111-T4; 6022-T4; 6016-T4), advanced high strength steel (AHSS) (DP500 steel) and similar materials for outer skin panels. One of the major problems for implementation of AHSS and aluminum alloys for outer skin panels is splitting of the sheet material from the trimmed surface in stretch flanging and stretch hemming areas. Attempts to reduce the radius of a hem or flange have resulted in splits along the flanging line. Applicants have proposed a two-step flanging operation in which a large radius bend is first made and then a smaller radius bend is made on the larger radius bend. A cam former that requires a complex tooling arrangement may be used to form a smaller radius bend after a larger radius bend is made in a normal flange forming die.

A simpler tooling configuration would be preferable that could obtain sharp flanging in a single step. A tooling solution would be preferred that would facilitate combining and simplifying the steps of drawing, trimming and flanging. There is a need for a flange forming and trimming tool that can form a sharper peripheral radii on a flange in one step without employing an expensive cam mechanism and without requiring an extra stamping operation.

Flange splitting from the sheared surface is a barrier to implementation of higher strength lower guage AHSS steels, such as DP500, for outer skin panels in auto industry. It is also a reason for the limited implementation of aluminum on vehicles. The use of aluminum in vehicle body parts has frequently been limited to hoods, with substantial difficulties being encountered when it is attempted to use aluminum for fenders and decklids.

In conventional sheet metal forming operations a flange is first trimmed and then flanged. Tooling dies may become contaminated with slivers that are formed when a flange splits. Slivers can be spread to the subsequent operations from the trimming operation because it is usually not a final part forming operation. Elimination of slivers is important for outer skin panels that must have a high quality class A surface.

Another problem is that aluminum or AHSS alloy panels tend to spring-back elastically after cold forming. Spring-back can be accommodated and remedied by re-striking the panel to eliminate stresses in the metal that cause spring-back.

These and other problems are addressed by Applicant's disclosure as summarized below.

SUMMARY

A method of forming a flange on a sheet metal panel to reduce spring back in a drawn panel is disclosed. A part is drawn in a die that includes a part forming area and a draw panel clamping flange. A flange is formed in a flange forming area that is outboard of the part. The flange forming area includes an inner clamping ring and an outer clamping ring on opposite inner and outer sides of a flange forming member. The drawn part is stretched by clamping the inner clamping ring and the outer clamping ring against the flange while the flange forming member stretches the flange.

According to another aspect of the disclosure, method of forming a sharp flange on a sheet metal panel is disclosed. A part is drawn in a die. A clamping flange includes a flange forming area that is outboard of the part. A flange forming member is disposed in the flange forming area. An inner clamping ring is provided on an inner side of the flange forming member, and an outer clamping ring on an outer side of the flange forming member. A flange is formed on the panel with the flange forming member in a die cavity that is larger than the flange forming member. The die cavity defines a gap between the panel and the die cavity. A liquid is pumped under pressure through a channel in the flange forming member to expand the flange to fill the gap defined between the panel and the die cavity.

According to another aspect of the disclosure, a tool for flanging and trimming a sheet metal blank is disclosed. An upper draw die has a punch for forming a part. An inner clamping ring, an outer clamping ring, and a flange forming tool that is disposed between the inner and outer clamping rings is provided in the draw operation or in a subsequent operation. A first shearing edge is provided on the flange forming die. A lower die defines a part drawing cavity, a flange forming recess and a second shearing edge. The first and second shearing edges engage opposite sides of the blank to trim the flange.

According to another aspect of the disclosure, a method is disclosed for forming a tight radius flange on a sheet metal panel with a reciprocating ram that has an elastomeric former. A clamped portion of a part is clamped in a die between an upper member and a lower member with freestanding lip portion extending from between the upper and lower members. The lip portion is engaged and formed in a first direction that is parallel to the direction that the ram reciprocates to engage the lip portion to form the lip into a flange that extends in the first direction. The elastomeric former is compressed to expand the former in a second direction that is perpendicular to the first direction, wherein expansion of the former causes the flange to be formed in the second direction.

These and other aspects of the disclosure will be better understood in view of the attached drawings and the following detailed description of the illustrated embodiments.

DETAILED DESCRIPTION

Figure 1:
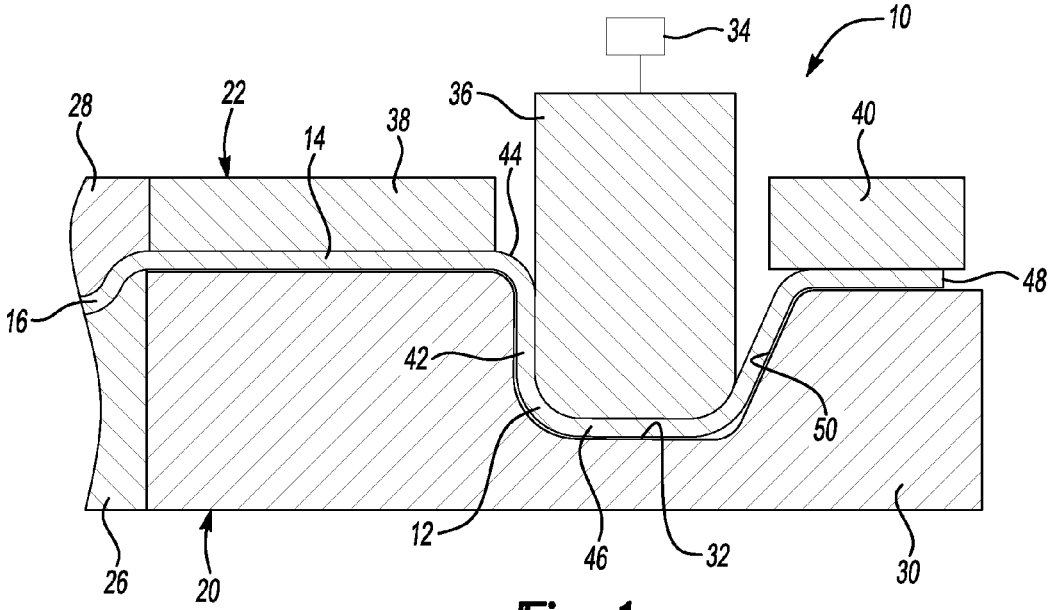
FIG. 1 is a fragmentary diagrammatic cross-section view of a flanging tool that clamps a flange forming area of a partially formed panel while a flange former stretches out spring back in a previously drawn panel.

Referring to FIG. 1, a flange tool 10 that is used to form a flange 12 on a peripheral portion 14 of a partially formed part 16. The flange tool 10 includes a lower die set 20 and an upper die set 22 that act on opposite sides of the partially formed part 16. A lower part forming die 26 and an upper part forming die 28 form the partially formed part 16 to a desired shape and contour. A lower flange forming die 30 defines a flange forming cavity 32. An actuator 34, such as a hydraulic cylinder, pneumatic cylinder, or press drive linkage, drives a flange former 36 into engagement with the partially formed part to stretch the previously drawn area to form a flange and stretch out spring back in the flange 12. An inner clamping ring 38 and an outer clamping ring 40 clamp the peripheral portion 14 of the partially formed part 16, while the flange former 36 stretches the hem flange area 42. A flange bend 44 is provided at the transition between the peripheral portion 14 that is clamped between the inner clamping ring 38 and the lower flange forming die 30. The hem flange area 42 extends generally perpendicular to the peripheral portion 14 and is the type of flange that is later formed in a reversely turned hem to secure an outer panel to an inner panel. A flange bend 44 is provided at the transition between the peripheral portion 14 and the hem flange area 42. A weld flange area 46 is also shown that is the type of flange that is welded to one or more other parts. Offal 48 is created in the course of the flange forming process that may be trimmed away from the part 16 in the course of the part forming process. A bevelled wall 50 may be provided on the outer portion of the flange forming cavity 32 to facilitate drawing metal from between the outer clamping ring 40 and the lower flange forming die 30 as the flange is stretched into its desired shape.

Figure 2:
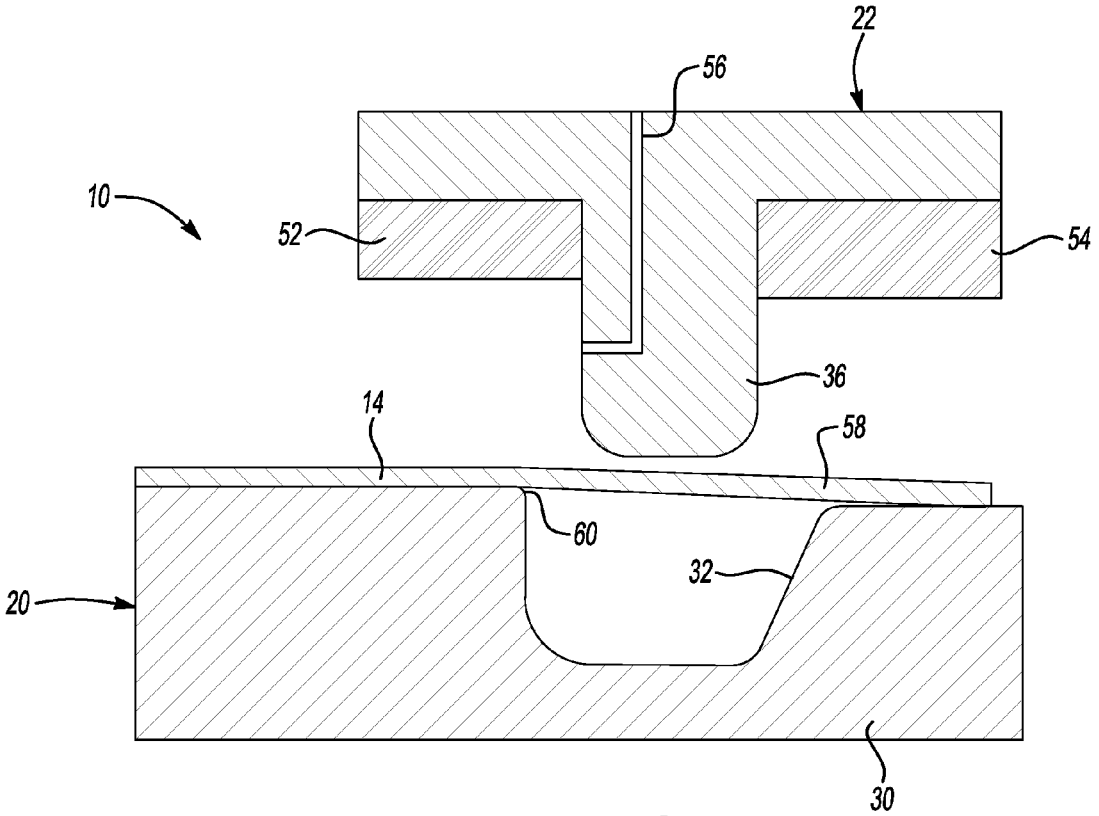
FIG. 2 is a diagrammatic cross-sectional view of a flanging tool prior to engaging a blank disposed on a lower die.
Figure 3:
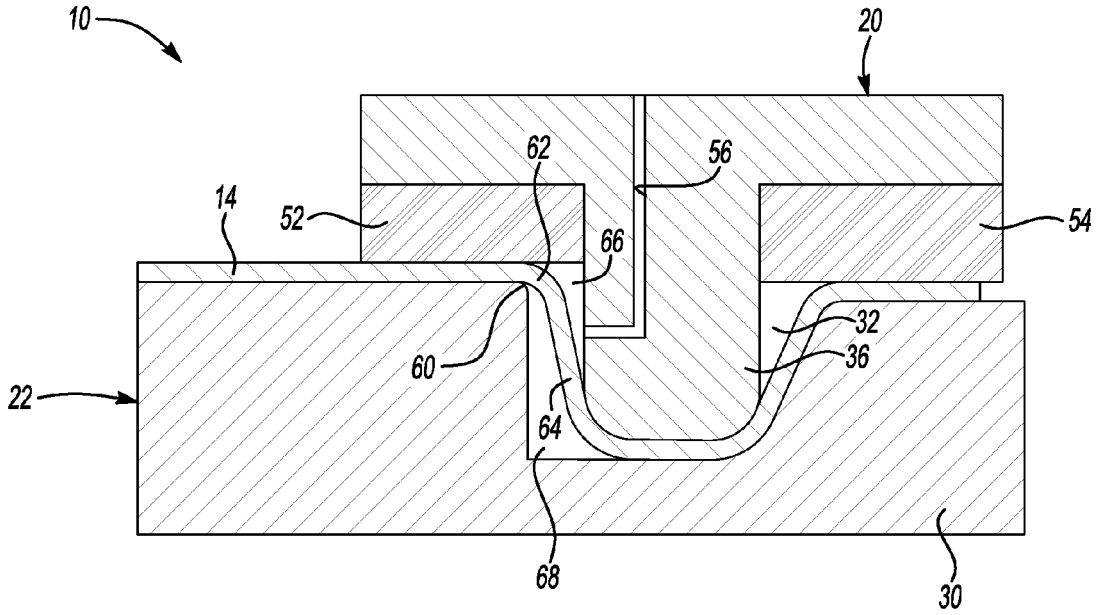
FIG. 3 is a diagrammatic cross-sectional view of the flanging tool shown in FIG. 2 in a first stage of forming a flange having a large radius.
Figure 4:
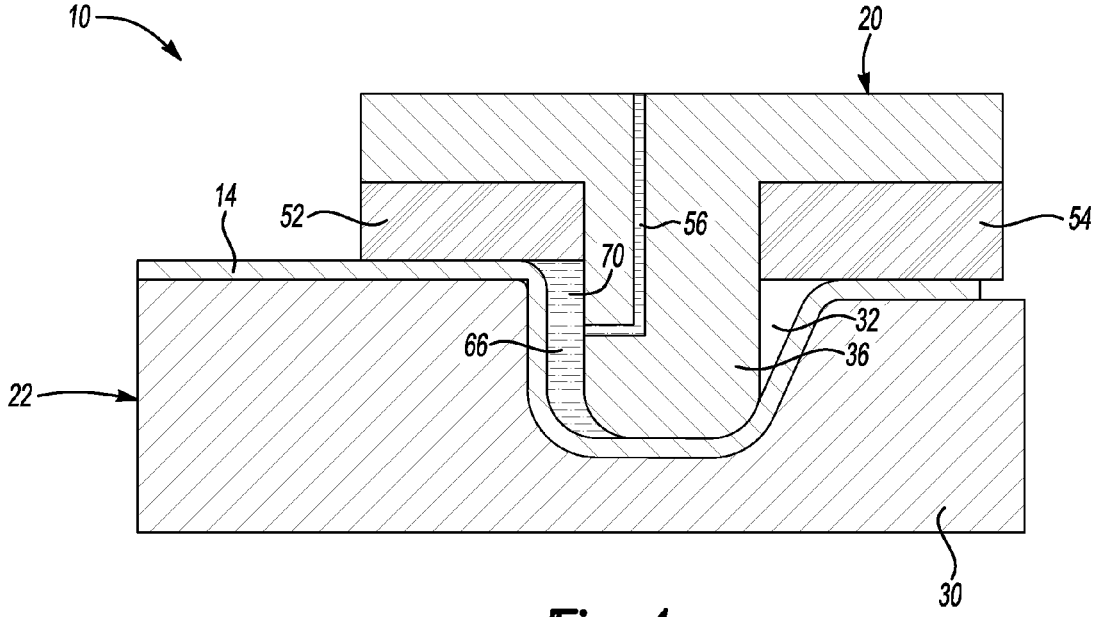
FIG. 4 is a diagrammatic cross-sectional view of the flanging tool shown in FIGS. 2 and 3 after a liquid is pumped into a space between the panel and the flange former to hydroform the flange to form a smaller radius.

Referring to FIGS. 2-4, an alternative embodiment of a flange tool 10 is shown. For brevity, reference numerals are carried over where possible in the embodiment disclosed in relation to FIG. 1. The flange tool 10, shown in FIGS. 2-4, includes a lower die set 20 and an upper die set 22. A lower flange forming die 30 defines a flange forming cavity 32. The flange former 36 is part of the upper die set 22 and includes an inner seal 52 and an outer seal 54. A fluid supply port 56 is provided through the flange former 36 through which hydrostatic forming pressure is applied to complete the process of forming the flange. The flange former 36 is reciprocally driven by a press, or other actuator, into engagement with a blank 58 or more specifically is driven into a peripheral portion 14 of the blank 58.

Referring to FIG. 2, the lower die set 20 and upper die set 22 are shown with the blank 58 being disposed on top of the lower die set 20.

Referring to FIG. 3, the flange former 36 is shown bottomed out in the flange forming cavity 32. The peripheral portion 14 is shown formed into the flange forming cavity 32.

A sharp radius bend tool edge 60 is provided at the inner edge of the cavity 32. As shown in FIG. 3, a wide radius bend 62 is initially formed in the peripheral portion 14 and a partially formed flange area 64 is formed into the flange forming cavity 32. A fluid cavity 66 is defined between the partially formed flange area 64, the flange former 36 and the seal 52. An expansion cavity 68 is defined between the partially formed flange area 64 and the cavity 32.

Referring to FIG. 4, fluid 70 is provided under pressure through the fluid supply port 56 that is used to hydroform the partially formed flange area 64, shown in FIG. 3, into a flange having a sharp radius bend against the sharp radius bend tool edge 60.

In an alternative embodiment, the fluid may be ported through a fluid supply port 56 to other areas of the flange forming cavity 32.

Figure 5:
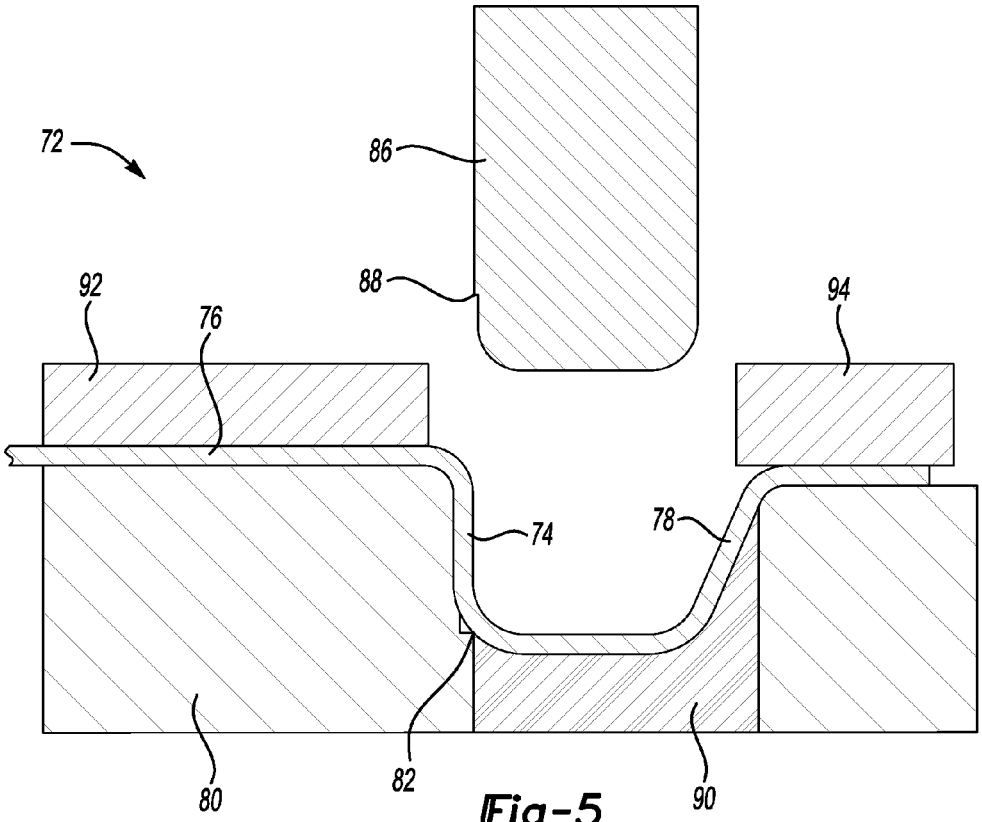
FIG. 5 is a diagrammatic cross-section view of a hem flange trimming tool for trimming and stretching out spring back prior to engaging the blank with a trimming tool.
Figure 6:
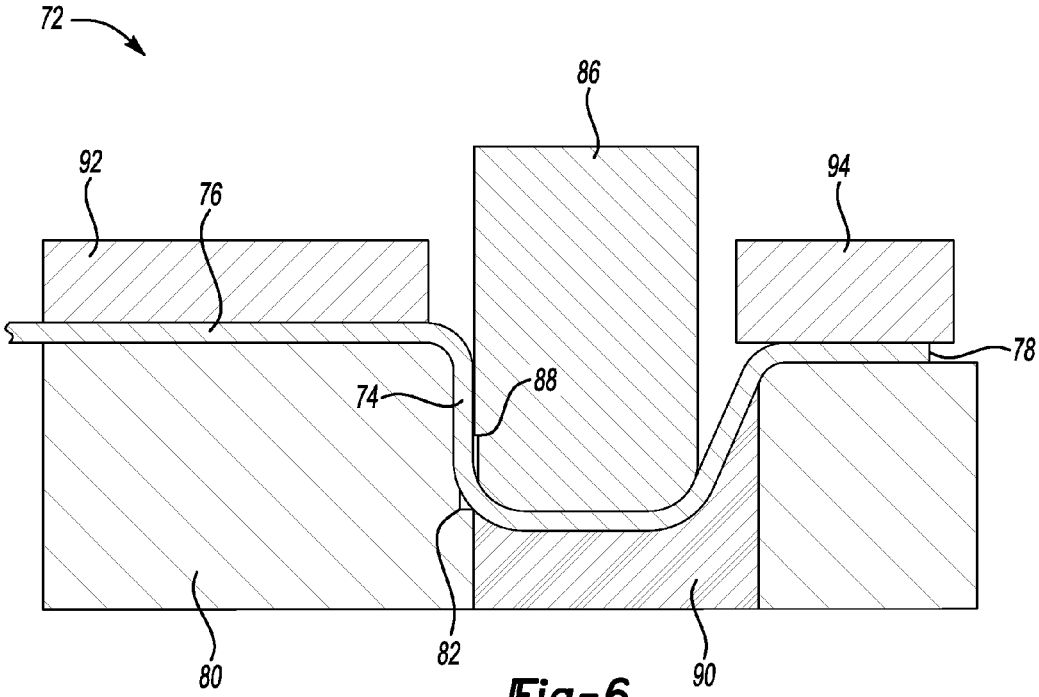
FIG. 6 is a diagrammatic cross-section view of the hem flange trimming tool of FIG. 5 engaging the panel in the flange area prior to trimming.
Figure 7:
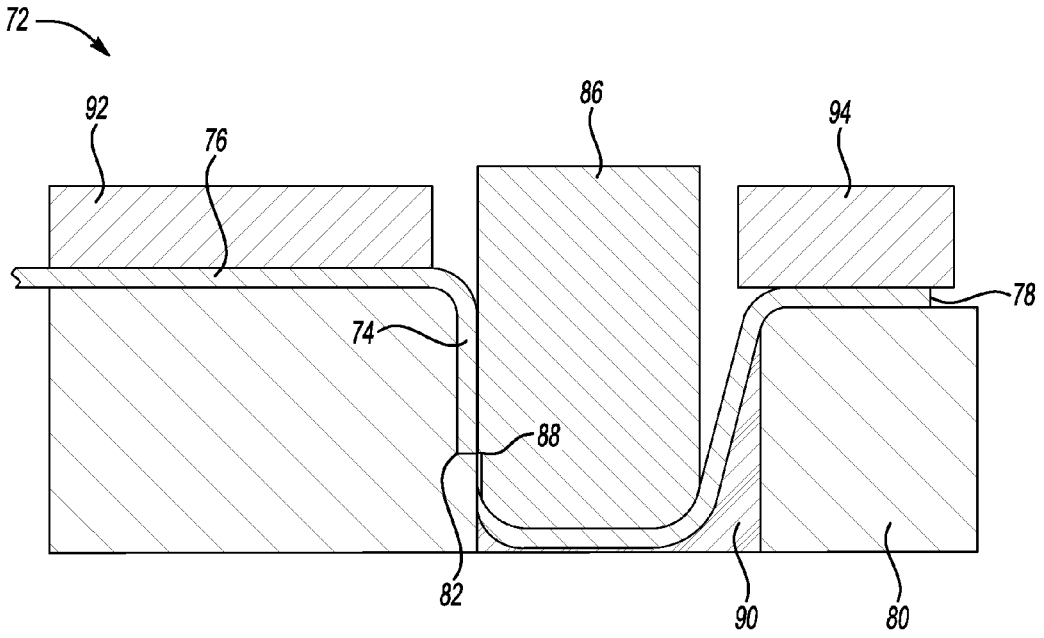
FIG. 7 is a diagrammatic cross-section view of the hem flange trimming tool shown in FIGS. 5 and 6 after completion of the trimming step.

Referring to FIGS. 5-7, a tool 72 is shown forming and trimming a hem flange 74 in a panel 76. The portion of the panel 76 that is cut off from the panel is referred to as offal 78. The tool 72 includes a lower trim die 80 that has a lower shearing edge 82. An upper trim die 86 has an upper shearing edge 88. The upper and lower shearing edges 88 and 82 cooperate to trim the offal 78 from the panel 76 in the area of the hem flange 74. A spring pad 90 is provided in the lower trim die 80. The spring pad is preferably an elastomeric spring pad. Alternatively, it could be a mechanical spring pad. The panel 76 is retained on the lower trim die 80 by an inner clamping ring 92 and an outer clamping ring 94.

As shown in FIG. 5, the upper trim die 86 is shown disposed above the lower trim die 80 before the trimming operation. The flange may be partially pre-formed, as shown in FIG. 5, so that is received within the lower trim die 80. The flange can also be fully formed and trimmed in one operation starting from the drawn panel.

Referring to FIG. 6, the upper trim die 86 is shown in full contact with the panel 76, but before commencement of the trimming operation. In this position, the upper trim die 86 stretches the panel 76 to relieve stresses and reduce the spring back effect in the panel 76.

Referring to FIG. 7, the upper trim die 86 is shown at the point where the upper shearing edge 88 is driven into contact with the lower shearing edge 82. The spring pad 90 is shown compressed as a result of the displacement of the offal 78 portion of the panel 76. The hem flange 74 is formed to extend perpendicularly downwardly into the lower trim die 80.

Figure 8:
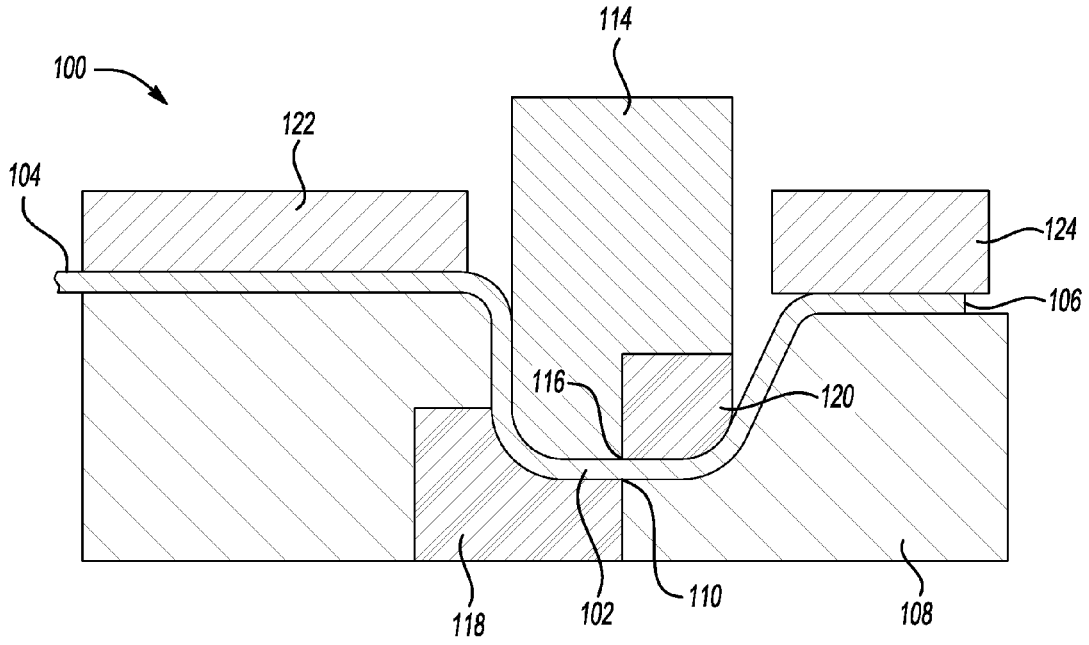
FIG. 8 is a diagrammatic cross-section view of a weld flanging and trimming tool showing the tool engaging the weld flange, but before beginning the trimming step.
Figure 9:
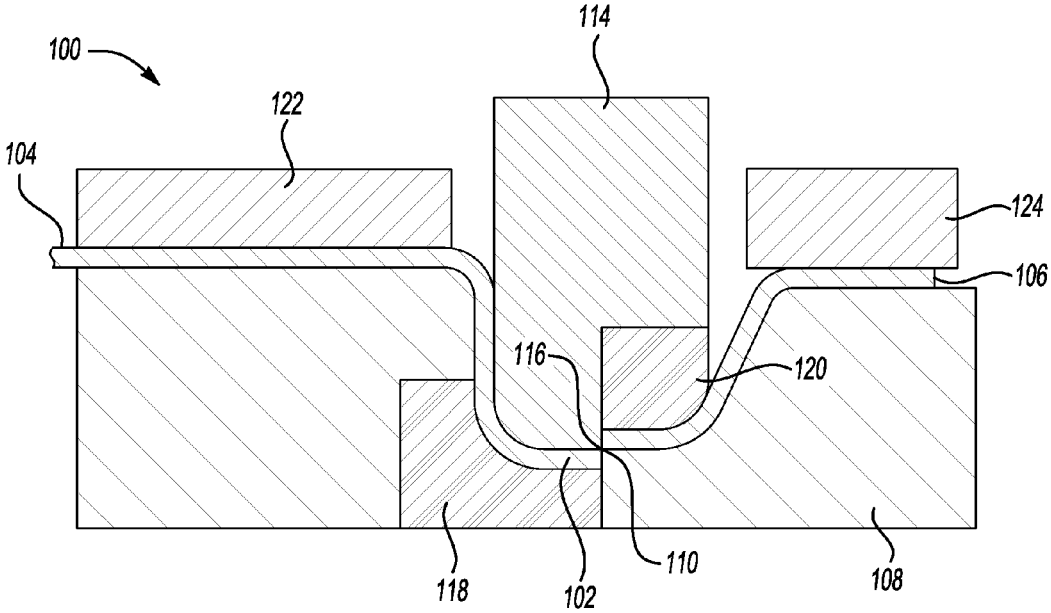
FIG. 9 is a diagrammatic cross-section view of the weld flanging and trimming tool shown in FIG. 8 after completing the trimming step.

Referring to FIGS. 8 and 9, an alternative embodiment of a trim tool 100 is illustrated that is used to form a weld flange 102 in a panel 104. The trim tool trims offal 106 from the panel 104. The trim tool includes a lower trim die 108 that has a lower shearing edge 110. The trim tool 100 also includes an upper trim die 114 that defines an upper shearing edge 116. A spring pad 118 is provided in the lower trim die 108. A spring pad 120 is provided in the upper trim die 114 and is adjacent to the upper shearing edge 116. The spring pad 118 is adjacent to the lower shearing edge 110 of the lower trim die 108. The spring pad 118 and spring pad 120 may be elastomeric pads, as illustrated, or alternatively may be made of another material or with other structure that is compressed with the upper trim die 114 is driven into the lower trim die 108 to trim the panel 104. An inner clamping ring 122 and an outer clamping ring 124 clamp the panel 104 and the offal 106 against the lower trim die 108.

Referring to FIG. 8, the upper trim die 114 is shown in contact with the panel 104 prior to trimming the offal 106 from the panel 104. The upper trim die 114 continues to move toward the lower trim die 108, as shown in FIG. 9.

Referring to FIG. 9, the upper trim die 114 is shown with the upper shearing edge 116 in engagement with the lower shearing edge 110 of the lower trim die 108. The offal 106 is trimmed from the panel 104 and the spring pad 118 and spring pad 120 are shown in a compressed condition.

Referring to FIGS. 10-14, a flange tool 130 is illustrated that acts upon a panel 132. A free standing portion 134 of the panel 132 extends from a lower die 136. The flange tool 130 includes a flange former ram 140 that has a former 142 that may be formed from an elastomeric material or the like. A lower flange former die 144 is attached to the lower die 136 or integrally formed therewith to define a cavity 146.

A radiused corner 148 is formed on the former 142. A sharp flange bending edge 150 is formed on the lower die 136 at the edge of the cavity 146.

Figure 10:
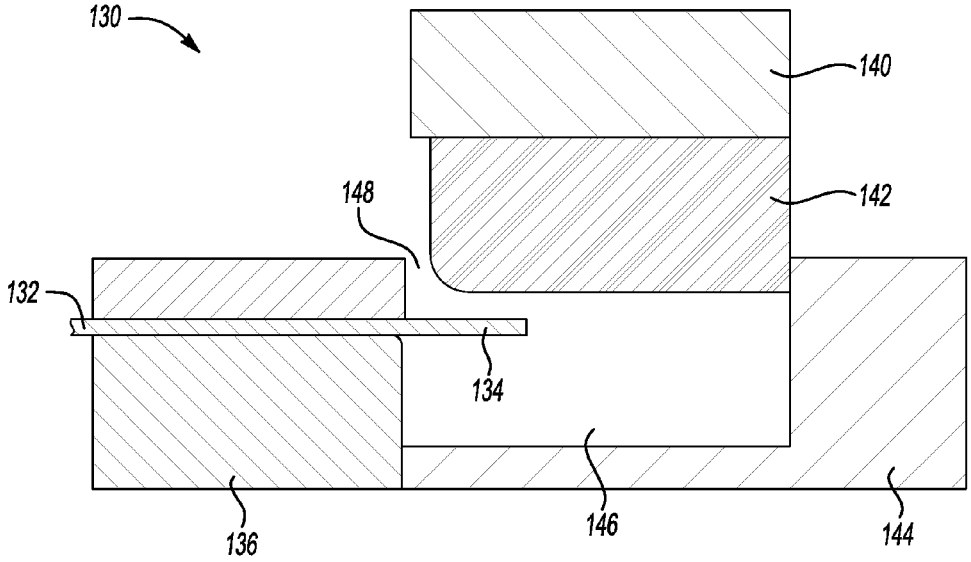
FIG. 10 is a diagrammatic cross-section view of a flanging tool that includes an elastomeric former that initially forms a flange to a larger radius and is then compressed to expand the former and form the flange to a smaller radius with the tool being shown in its initial position.

Referring specifically to FIG. 10, the flange former ram 140 is shown with the former 142 just prior to engagement with the free standing portion 134 of the panel 132.

Figure 11:
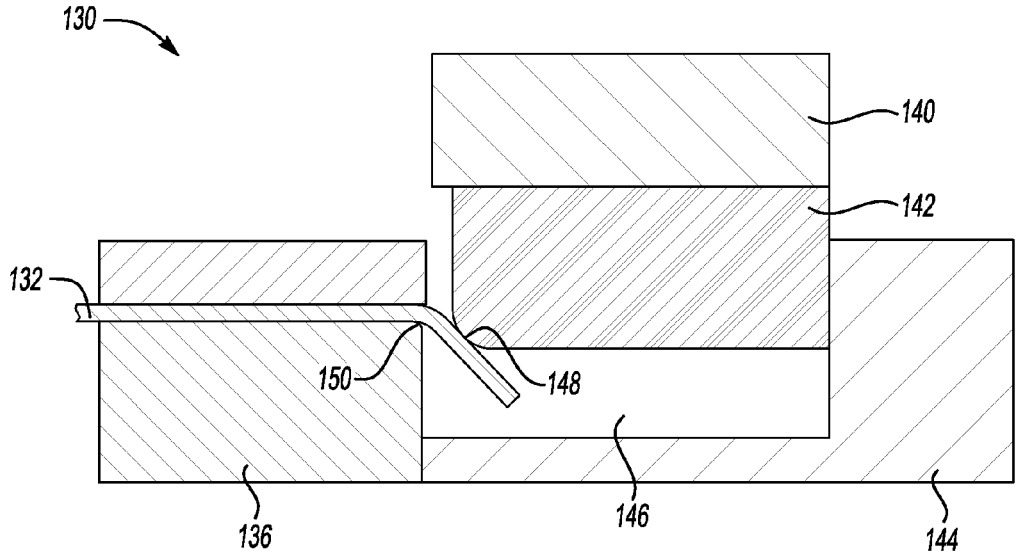
FIG. 11 is a diagrammatic cross-section view of the flanging tool of FIG. 10 shown initially engaging the panel to begin forming the flange.

Referring to FIG. 11, the flange tool 130 is shown with the radiused corner 148 of the former 142 engaging the free standing portion 134 (shown in FIG. 10) to bend it at the sharp flange bending edge 150. At this point, the former 142 is bending the free standing portion 134 (shown in FIG. 10), but is not forming a sharp flange edge.

Figure 12:
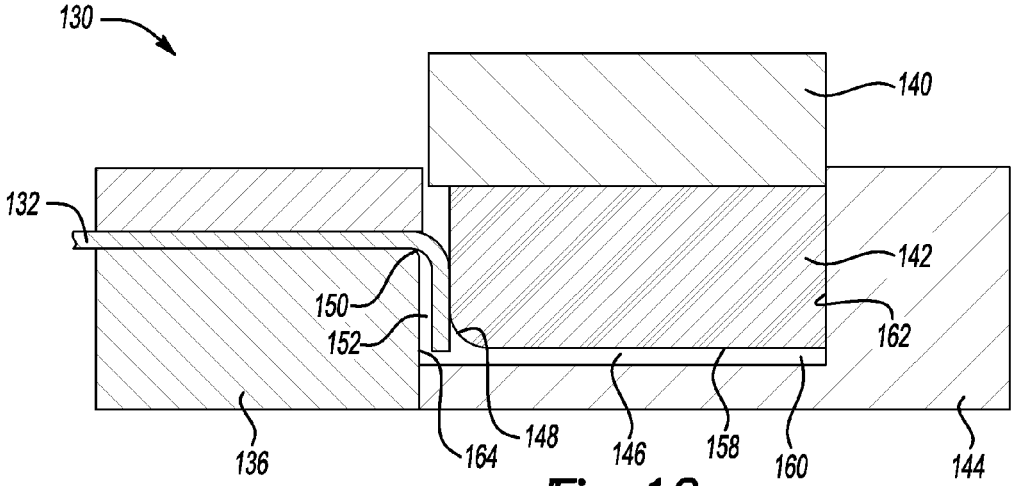
FIG. 12 is a diagrammatic cross-section view of the flanging tool shown in FIGS. 10 and 11 with the flange formed to a large radius.

Referring to FIG. 12, the free standing portion 134 (shown in FIG. 10) of the panel 132 is shown bent to a generally perpendicular orientation relative to the other portions of the panel 132. A clearance gap 152 is defined between the perpendicularly bent free standing portion 134 and the lower die 136. A large radius bend 156 (shown in FIG. 13) is formed about the sharp flange bending edge 150, but the flange is not sharply bent at this point.

Figure 13:
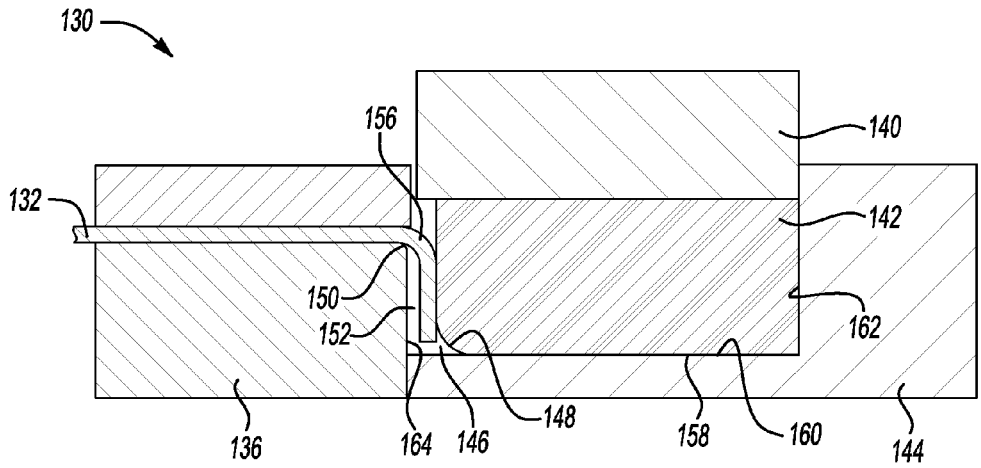
FIG. 13 is a diagrammatic cross-section view of the tool shown in FIGS. 10 through 12 just prior to compressing the elastomeric flange former.

Referring to FIG. 13, the flange tool 130 is shown with a bottom surface 158 of the former 142 engaging an end wall 160 of the lower flange forming die 144. At this point in the process, the former 142 is not yet compressed against the end wall 160.

Figure 14:
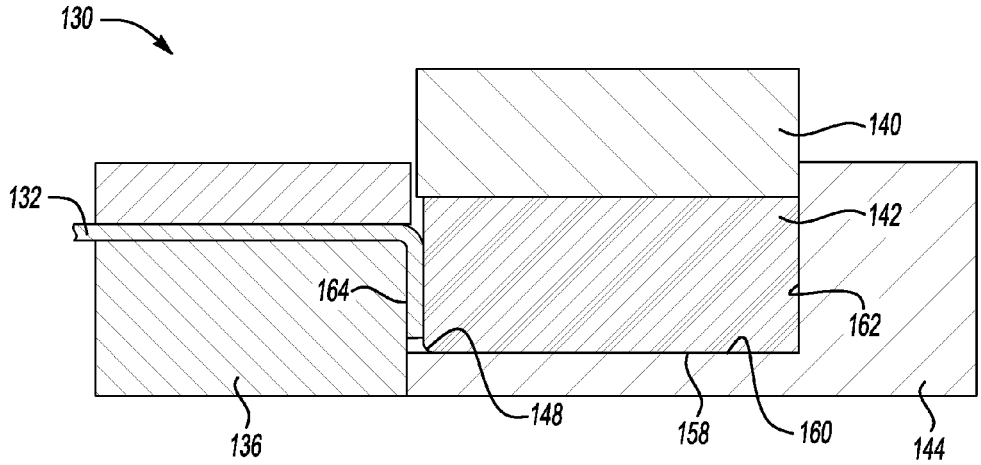
FIG. 14 is a diagrammatic cross-section view of the toll shown in FIGS. 10-13 after compression of the elastomeric former to cause the flange to be formed with a smaller radius.

Referring to FIG. 14, the flange tool 130 is shown with the flange former ram 140 compressing the former 142 so that it expands and engages the free standing portion 134 (shown in FIG. 10) that was previously formed to be perpendicular to the panel 132. Compression of the former 142 causes the free standing portion to be driven into engagement with the flange forming wall 164 thereby causing the free standing portion 134 (shown in FIG. 10) to be stretched and formed about the sharp flange bending edge 150 thereby providing a flange with a smaller radius bend where the large radius bend 156 (shown in FIG. 13) is formed in the intermediate steps of the flanging process.

What is claimed:

1. A method of forming a flange on a sheet metal panel comprising:

drawing a part and forming a flange in a die that includes a part forming area and a flange forming area in a drawn part clamping flange, wherein the flange forming area is outboard of the part forming area, wherein a flange forming portion of the first die includes an inner clamping ring and an outer clamping ring on opposite inner and outer sides of a flange forming member that hold the sheet metal panel against the second die to form the flange of the drawn part; and stretching the flange formed on the drawn part after the drawing step by clamping the inner clamping ring and the outer clamping ring of the first die that holds the sheet metal panel against the second die and contacting the flange with the flange forming member to stretch the flange into a flange forming cavity defined by the second die.

2. The method of claim 1 further comprising trimming the flange formed on the drawn part.

3. The method of claim 2 wherein the sheet metal panel has a drawn panel clamping flange that extends in a horizontal direction and is engaged by the inner and outer clamping rings on one side and by a clamping surface on the second die, and wherein a first flange surface extends substantially perpendicular to the horizontal direction and wherein the step of trimming the flange is performed on the first flange after the stretching step.

4. The method of claim 2 wherein the sheet metal panel has a drawn panel clamping flange that extends in a horizontal direction and is engaged by the inner and outer clamping rings on one side and by a clamping surface on the second die, and wherein a first flange surface extends substantially perpendicular to the horizontal direction, a second flange surface extends substantially parallel to the horizontal direction and wherein the step of trimming the flange is performed on the second flange surface after the stretching step.

* * * * *